US006925680B2

(12) United States Patent
Oh

(10) Patent No.: US 6,925,680 B2
(45) Date of Patent: Aug. 9, 2005

(54) VACUUM CLEANER HAVING CYCLONE DUST COLLECTING APPARATUS

(75) Inventor: Jang-keun Oh, Gwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 366 days.

(21) Appl. No.: 10/206,323

(22) Filed: Jul. 29, 2002

(65) Prior Publication Data

US 2003/0167591 A1 Sep. 11, 2003

(30) Foreign Application Priority Data

Mar. 7, 2002 (KR) ..... 2002-0012180

(51) Int. Cl.[7] ..... A47L 9/16

(52) U.S. Cl. ..... 15/350; 15/352; 15/353; 15/327.1; 55/429; 55/459.1; 55/DIG. 3

(58) Field of Search ..... 15/327.1, 350, 15/352, 353; 55/337, 429, 459.1, DIG. 3

(56) References Cited

U.S. PATENT DOCUMENTS 4,960,446 A * 10/1990 Werner et al. ..... 15/352
5,350,432 A 9/1994 Lee
5,950,274 A * 9/1999 Kilström ..... 15/350
6,141,826 A * 11/2000 Conrad et al. ..... 15/347
6,195,835 B1 3/2001 Song et al.
6,428,589 B1 * 8/2002 Bair et al. ..... 15/353
6,558,453 B2 * 5/2003 Sepke et al. ..... 15/353

FOREIGN PATENT DOCUMENTS

DE 19945403 A1 6/2000
EP 0827710 3/1998
WO WO 00/49932 8/2000

* cited by examiner

*Primary Examiner*—Theresa T. Snider
(74) *Attorney, Agent, or Firm*—Plumsea Law Group, LLC

(57) ABSTRACT

A cyclone dust collecting apparatus for a canister type vacuum cleaner has a connection pipe connected to a suction brush, a cyclone body, and a dust collecting receptacle provided in the cyclone body. The dust collecting receptacle is positioned alongside the connection pipe, and the contacting side of the connection pipe is contoured to correspond to the shape of the outer contour of the dust collecting apparatus. The mating contact of the connection pipe and the dust collecting receptacle reduces the overall thickness of their coextensive lengths and provides a secure connection therebetween. The resulting compact configuration enables a user to use or carry the cyclone dust collecting apparatus more conveniently.

14 Claims, 5 Drawing Sheets

VACUUM CLEANER HAVING CYCLONE DUST COLLECTING APPARATUS

BACKGROUND OF THE INVENTION

1. Field of the Invention

The present invention relates to a vacuum cleaner, and more particularly to a vacuum cleaner having a cyclone dust collecting apparatus matingly disposed along a connection pipe, and capable of filtering out and collecting relatively large particle contaminants from dirt-laden air drawn in through a suction port.

2. Description of the Prior Art

As shown in FIG. 1, a vacuum cleaner has a cleaner body 1, a connection hose 2 connected to the cleaner body 1, an extension pipe 3 connected to connection hose 2 and a suction port 4 connected to an end of the extension pipe 3. A cover 5 is pivotally mounted on cleaner body 1, and cover 5 is connected to connection hose 2. Cleaner body 1 has a dust collecting chamber 6 inside. A paper filter 7 is removably received in chamber 6 to collect contaminants such as dust which are vacuumed through suction port 4. A handle grip 8 is provided between connection hose 2 and extension pipe 3. The handle grip provides a location for a user to easily manipulate extension pipe 3 and thereby guide suction port 4 during the cleaning operation.

The vacuum cleaner also includes a motor (not shown) mounted in the cleaner body 1 to generate a suction force to draw in dirt-laden air through suction port 4. The dirt-laden air is drawn into cleaner body 1 via extension pipe 3 and connection hose 2. Solid contaminants are filtered at paper filter 7 that is disposed in the dust collecting chamber of the cleaner body 1, while the exiting air is discharged outside of the cleaner body 1.

In the general vacuum cleaner as described above, all of the solid contaminants in the dirt-laden air that is drawn in through the suction port 4 are filtered out at only a single paper filter 7 disposed in the dust collecting chamber 6 of the cleaner body 1. As a result, paper filter 7 becomes filled with contaminants quickly and must be replaced often in order to prevent overloading the motor and decreasing the suction force. Accordingly, frequent replacement of this disposable filter increases waste and the cost of operation due to the need to purchase replacement filters.

In an attempt to solve this problem, a vacuum cleaner having a cyclone dust collecting apparatus 10 has been suggested. A cyclone dust collecting apparatus serves as a first stage filtration area so the filter in body 1 can serve as a second stage filtration area. The collected debris in the cyclone dust collecting apparatus can be simply dumped without the use of disposable filters.

As shown in FIGS. 1 and 2, the cyclone dust collecting apparatus 10 is connected and thus disposed at a part of the extension pipe 3 that connects the cleaner body 1 and the suction brush 4.

Cyclone dust collecting apparatus 10 includes a cyclone body 20 having first and second connection pipes 11 and 12, respectively, a dust collecting receptacle 30 removably connected to cyclone body 20, and a filter member 40 positioned in dust collecting receptacle 30. The first connection pipe 11 is connected to extension pipe 3' proximate suction port 4 and second connection pipe 12 is connected to extension pipe 3" proximate cleaner body 1. Dust collecting receptacle 30 has a substantially cylindrical shape. Dust collecting receptacle 30 can also have a shape of a tapered cylinder which grows narrower as it extends downward.

In operation, dirt-laden air, drawn in through the suction port 4, is drawn through an air inlet 11*a* of first connection pipe 11 into the cyclone body 20 in a diagonal relation with respect to cyclone body 20. As the air current flows diagonally into the cyclone body 20, an air vortex is generated in cyclone body 20 and dust collecting receptacle 30 in a direction indicated by the solid-lined arrows in FIG. 2. As a result of the vortex air current, a centrifugal force is generated, separating large particle contaminants from the air. The separated contaminants fall and then are entrained in an upturning air current (indicated by the dot-lined arrows of FIG. 5) and then reflected from the bottom of dust collecting receptacle 30. In the upturning air current, the separated contaminants are discharged toward the cleaner body 1 through an air outlet 12*a* formed in the cyclone body 20.

Meanwhile, filter member 40 within receptacle 30 prevents the contaminants from reversing together with the air flowing through air outlet 12*a* of cyclone body 20 during the operation of cyclone dust collecting apparatus 10.

The vacuum cleaner having such a cyclone dust collecting apparatus 10, is constructed such that the large particle contaminants of the dirt-laden air drawn in through the suction port 4 are pre-filtered in the cyclone apparatus before the dirt-laden air flows to the paper filter 7. In this manner, the cyclone apparatus functions as a first stage filtration device, and the air exiting the apparatus is directed to paper filter 7 to undergo an additional filtration step. Accordingly, the amount of contaminants to be filtered by paper filter 7 decreases, and the lifespan of paper filter 7 is lengthened. Also, by pre-filtering large particle contaminants, other advantages like prevention of suction force deterioration and motor overload are expected.

A detraction of the vacuum cleaner having the cyclone dust collecting apparatus 10 as described above, is that, the presence of cylindrical dust collecting receptacle 30 along cylindrical extension pipe 3 inevitably increases the overall volume of the cleaner. The rather bulky volume of the cleaner is cumbersome, and a user often finds it tiresome to use the cleaner and to move it as necessary during the cleaning operation.

SUMMARY OF THE INVENTION

The present invention has been made to overcome the above-mentioned problems of the prior art. Accordingly, it is an object of the present invention to provide a cyclone dust collecting apparatus for use in a vacuum cleaner having a reduced size.

Another object of the present invention is to provide a cyclone dust collecting apparatus which facilitates easy manipulation for a user to carry the same during a cleaning operation.

The cyclone dust collecting apparatus for use in a vacuum cleaner according to the present invention includes many of the same features as the vacuum cleaner described above the dust collecting receptacle is positioned along side the connection pipe, with the connection pipe having a shape that matingly follows the outer surface of the dust collecting receptacle.

The dust collecting receptacle has a generally cylindrical shape so that in a horizontal sectional view its profile is substantially circular. The side of the connection pipe proximate the receptacle is contoured to correspond to the outer side of the cylindrical dust collecting receptacle. The cross-section of the connection pipe is substantially rectangular with a contoured side that is concave to matingly accommodate the circular profile of the receptacle.

According to the present invention, the overall width of the extension pipe and the dust collecting receptacle is reduced by this mating geometry, and accordingly, the vacuum cleaner is more compact and easier to manipulate, carry and use.

The cyclone dust collecting apparatus also has a handle formed on the cyclone body. The handle is integrally formed with the cyclone body. Accordingly, the user can grip the handle, and perform the cleaning operation or carry the cyclone dust collecting apparatus with ease.

The above objects are also accomplished by a vacuum cleaner according to the present invention having the above cyclone dust collecting apparatus.

BRIEF DESCRIPTION OF THE DRAWINGS

The above-mentioned objects and the feature of the present invention will be more apparent by describing the preferred embodiment of the present invention in detail referring to the appended drawings, in which.

DETAILED DESCRIPTION OF A PREFERRED EMBODIMENT

Figure 1:
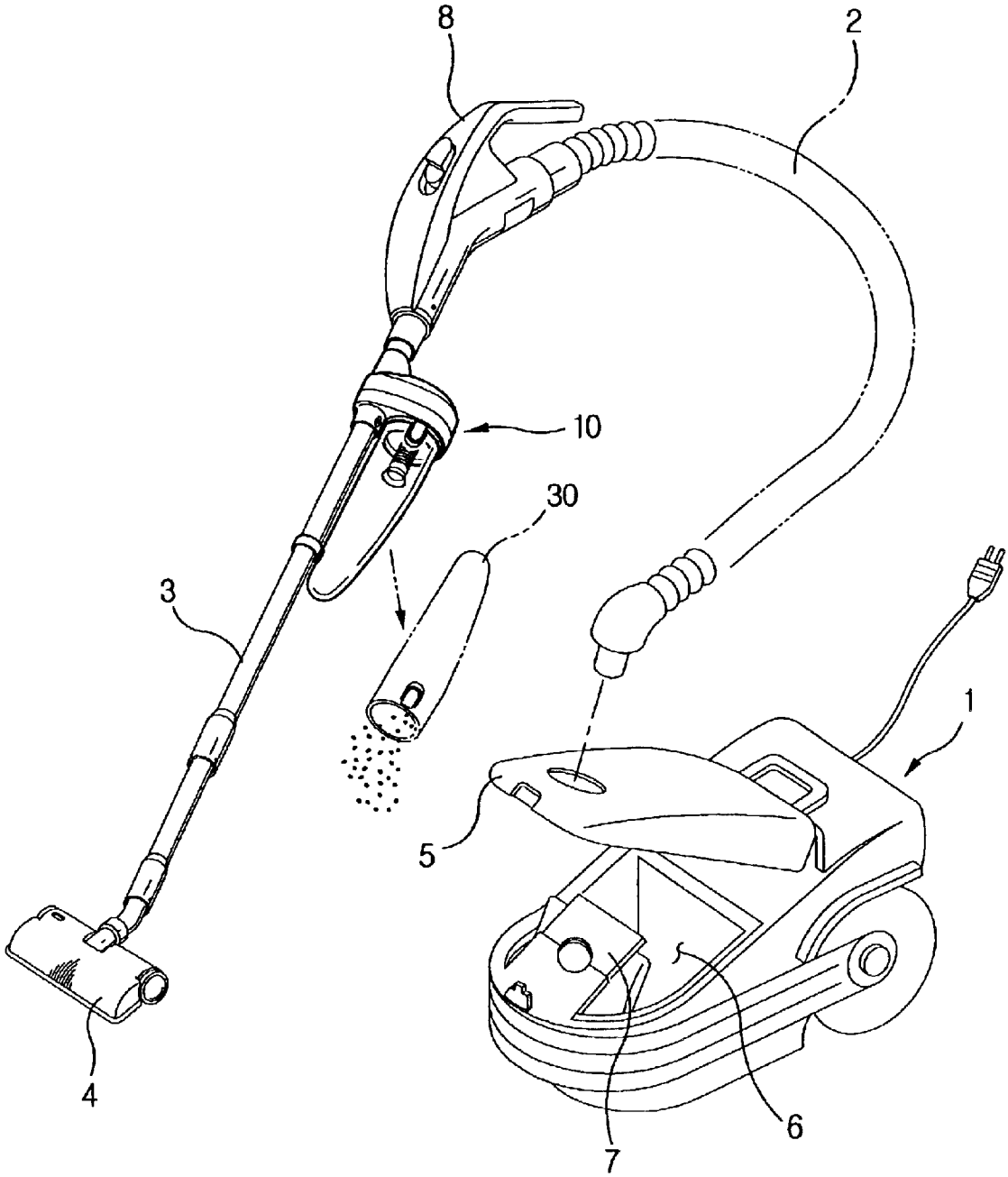
FIG.1 (PRIOR ART)
FIG. 1 is a perspective view of a vacuum cleaner with a conventional cyclone dust collecting apparatus.
Figure 2:
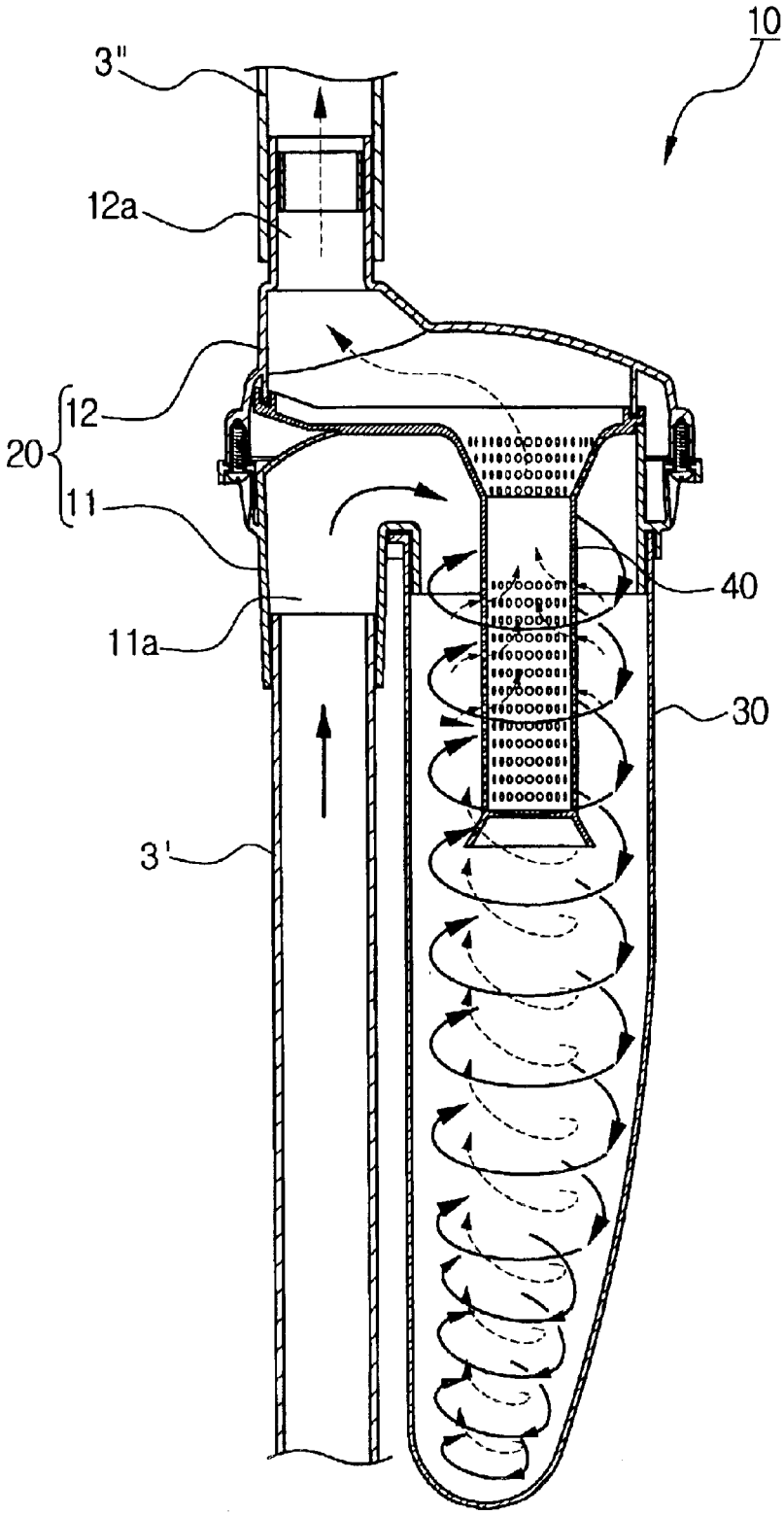
FIG.2 (PRIOR ART)
FIG. 2 is an enlarged sectional view of the cyclone dust collecting apparatus of FIG. 1.
Figure 3:
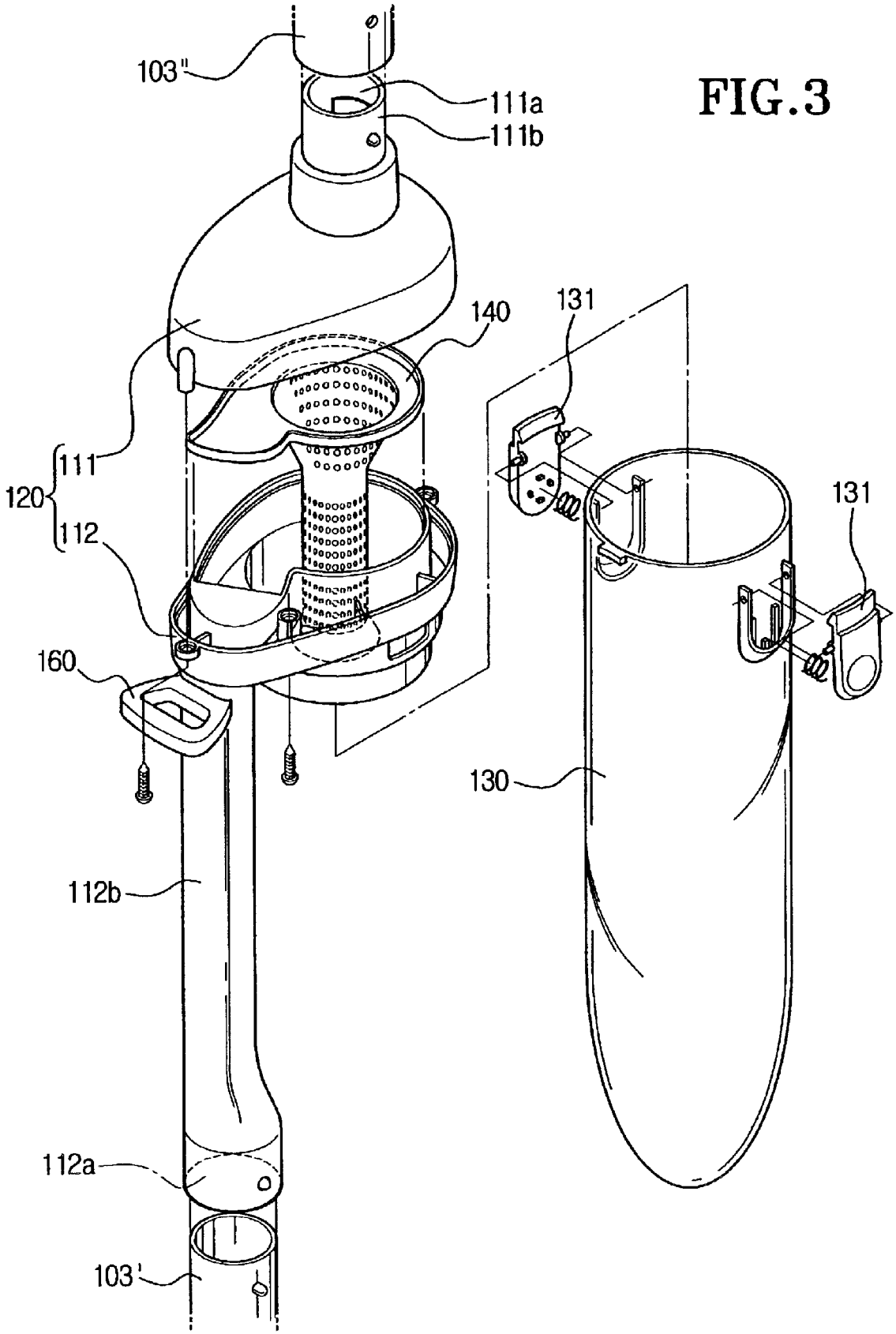
FIG. 3 is an exploded perspective view of a cyclone dust collecting apparatus according to the present invention.
Figure 4:
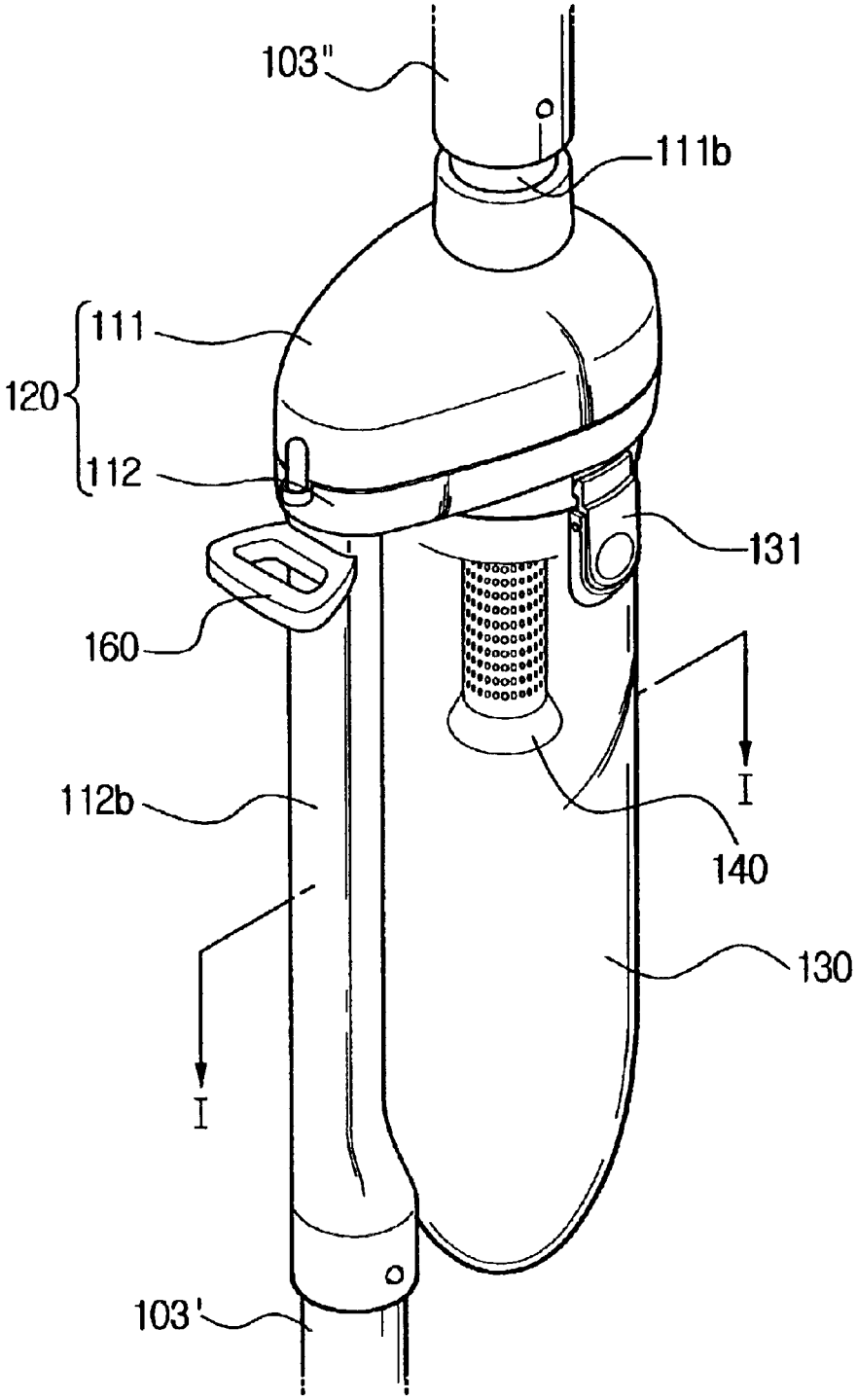
FIG. 4 is a view of the cyclone dust collecting apparatus of FIG. 3 assembled.
Figure 5:
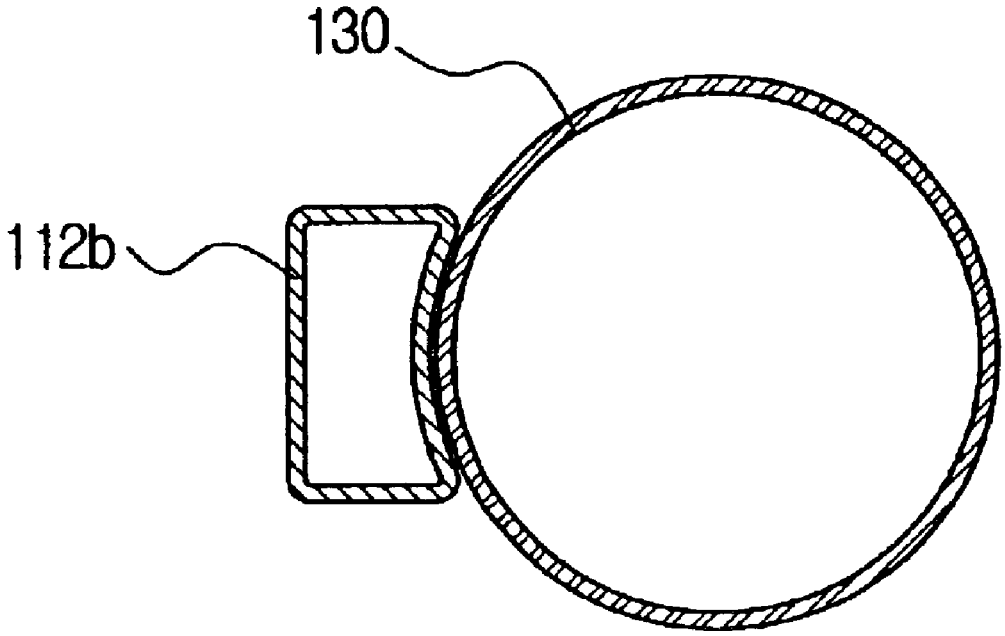
FIG. 5 is a cross-section taken on line I—I of FIG. 4.

A preferred embodiment of the present invention will be described in greater detail with reference to FIGS. 3 through 5. The description will focus on the novel aspects of the present invention with reference to the vacuum cleaner described above for aspects in common with the present invention. For convenience of description only, the location of elements of the vacuum cleaner will be described with respect to the one-directional airstream or suction force. For example, extension pipe 103' is upstream of cyclone body 120, and connection hose 103" is downstream of cyclone body 120. As shown in FIGS. 3 and 4, the cyclone dust collecting apparatus according to the present invention includes a first member 111 and a second member 112, constituting a cyclone body 120 in cooperation with each other, a filter member 140 is disposed in second member 112, and a dust collecting receptacle 130 is formed at a lower portion of second member 112. A connection pipe 111*b* is provided on an upper portion of first member 111 connecting to connection hose 103" that is connected with the cleaner body. At an end of connection pipe 111*b*, a discharge outlet 111*a* is formed. A connection pipe 112*b* is formed on second member 112, having a suction inlet 112*a* formed at an end thereof. The connection pipe 112*b* is connected to extension pipe 103' that is connected to the suction port of the vacuum cleaner.

Filter member 140 is disposed in second member 112, and dust collecting receptacle 130 is held at the lower portion of second member 112 by a fastening member 131. The air drawn in through the suction inlet 112*a* of cyclone body 120 forms a vortex air current in dust collecting receptacle 130, and then is discharged to connection hose 103" via discharge outlet 111*a*. Dust collecting receptacle 130 is positioned along side of connection pipe 112*b*. Connection pipe 112*b* of the present invention has a cross-sectional profile that matingly accommodates the cross-sectional geometry of receptacle 130 along at least a portion of its length. As shown in FIG. 5, a surface of connection pipe 112*b* which is proximate dust collecting receptacle 130 has a shape corresponding to the outer surface of dust collecting receptacle 130 so that these two pieces are fitted closely together along their coextensive portions. More specifically, dust collecting receptacle 130, in cross-section, is substantially circular, while the side of connection pipe 112*b* that extends alongside is contoured substantially in the shape of an arc to form a concave surface that geometrically mates with the receptacle wall. Since connection pipe 112*b* and dust collecting receptacle 130 are in tight contact with each other due to these respective structural characteristics they form a more compact overall profile and thus occupy less space.

The overall shape of connection pipe 112*b* in a horizontal cross-section along most of the portion that it is coextensive with the receptacle is approximately a rectangular shape.

The lower end of connection pipe 112*b* is cylindrical as shown in FIGS. 3 and 4 so as to be connectible to cylindrical extension pipe 103'. Thus, connection pipe 112*b* is designed such that the rectangular portion thereof transitions smoothly into the cylindrical portion.

Another feature to facilitate handling of the present invention is a handle 160 integrally formed on second member 112 of the cyclone body 120, and designed to have the size and shape that are appropriate for a user to easily grip the same. Handle 160 provides a user with a convenient grip when he/she performs a vacuum cleaning operation or carries the cyclone dust collecting apparatus.

The vacuum cleaner having the above-described cyclone dust collecting apparatus operates in a similar manner as the prior art vacuum cleaner described above in the Background section.

As described above, according to the present invention, the overall thickness of the combination of extension pipe 112*b* and dust collecting receptacle 130 is reduced, and accordingly, the vacuum cleaner is easier to use. Geometrically mating the outer surfaces of extension pipe 112*b* and receptacle 130 not only renders the apparatus more compact, but also provides an assembly guide surface along their contact areas for easy placement and assembly of the receptacle. In addition, an enhanced attachment is provided as the two elements have mating bearing surfaces, compared to the sole use of a fastener to join together two circular shapes along a single line as previously used instead of a surface. Further, the structural features are provided to facilitate cleaning operation or easy transport of the cyclone dust collecting apparatus by provision of handle 160 provided thereon.

Although the preferred embodiment of the present invention has been described, it will be understood by those skilled in the art that the present invention should not be limited to a described preferred embodiment, but various changes and modifications can be made within the spirit and scope of the present invention as defined by the appended claims.

What is claimed is:

1. A cyclone dust collecting apparatus for use in a vacuum cleaner, said apparatus adapted to be arranged between a suction port of the vacuum cleaner and a main body of the vacuum cleaner containing a motor and filter, said apparatus comprising:

a connection pipe adapted to be connected to the suction port of the vacuum cleaner;

a cyclone body in communication with said connection pipe and adapted to be connected to a connection hose that leads to the main body of the vacuum cleaner, said cyclone body comprising:

a dust collecting receptacle containing a filtering mechanism wherein dirt-laden air drawn in through the suction port forms a whirling current in the dust collecting receptacle and is then discharged to the connection hose;

wherein said dust collecting receptacle and said connection pipe are disposed alongside and in contact with one another along a portion of their respective lengths, and wherein a side of said connection pipe, that is in contact with said dust collecting receptacle, is concave and formed in a shape corresponding to said dust collecting receptacle.

2. The cyclone dust collecting apparatus of claim 1, wherein said dust collecting receptacle has a substantially cylindrical shape with a horizontal cross-section thereof being substantially circular, and said side of the connection pipe in contact therewith is contoured to correspond to the shape of said substantially cylindrical dust collecting receptacle.

3. The cyclone dust collecting apparatus of claim 1, further comprising a handle provided on said connection pipe of said cyclone body.

4. The cyclone dust collecting apparatus of claim 3, wherein said handle is integrally formed with said cyclone body.

5. A cyclone dust collecting apparatus for use in a vacuum cleaner, said apparatus adapted to be arranged between a suction port of the vacuum cleaner and a main body of the vacuum cleaner containing a motor and filter, said apparatus comprising:

a connection pipe adapted to be connected to the suction port of the vacuum cleaner;

a cyclone body in communication with said connection pipe and adapted to be connected to a connection hose that leads to the main body of the vacuum cleaner, said cyclone body comprising: a dust collecting receptacle containing a filtering mechanism wherein dirt-laden air drawn in through the suction port forms a whirling current in the dust collecting receptacle and is then discharged to the connection hose;

wherein said dust collecting receptacle and said connection pipe are disposed alongside and in contact with one another, a side of said connection pipe in contact with said dust collecting receptacle formed in a shape corresponding to said dust collecting receptacle;

wherein said connection pipe includes sides that are substantially flat so a horizontal cross-section of said connection pipe is substantially rectangular.

6. A vacuum cleaner including a main body containing a motor for generating a suction force and a filter, a connection hose extending from the main body, a suction port for confronting a surface to be cleaned, and an extension pipe connecting the suction port to the connection hose, said vacuum cleaner comprising a cyclone dust collecting apparatus disposed between the connection hose and the extension pipe, said apparatus comprising:

a connection pipe in communication with the connection hose and the extension pipe to channel an airstream therethrough;

a cyclone body attached to a downstream end of said connection pipe and containing a filtering mechanism;

a dust collecting receptacle attached to said cyclone body and arranged alongside and in contact with at least a portion of said connection pipe for collecting solid particles trapped by said filtering mechanism and for causing the airstream to travel in a cyclone current therein;

wherein said connection pipe and said receptacle have a mating geometry along respective contacting surfaces; and wherein said contact surface of said connection pipe is concave and substantially corresponds to the contacting surface of said receptacle.

7. The vacuum cleaner of claim 6, wherein said dust collecting receptacle has a substantially cylindrical shape.

8. The vacuum cleaner of claim 6, wherein said connection pipe has a substantially rectangular cross-section along at least a portion thereof.

9. The vacuum cleaner of claim 8, wherein said connection pipe comprises a portion of substantially circular cross-section to couple to a substantially circular cross-section portion of the extension pipe, and a transition portion between said portion of substantially rectangular cross-section and said portion of substantially circular cross-section.

10. The vacuum cleaner of claim 9, further comprising a handle provided on said cyclone body to facilitate use and handling of said vacuum cleaner.

11. The vacuum cleaner of claim 10, wherein said handle is integrally molded with said cyclone body.

12. The vacuum cleaner of claim 6, further comprising a handle provided on said cyclone body to facilitate use and handling of said vacuum cleaner.

13. The vacuum cleaner of claim 12, wherein said handle is integrally molded with said cyclone body.

14. A vacuum cleaner including a main body containing a motor for generating a suction force and a filter, a connection hose extending from the main body, a suction port for confronting a surface to be cleaned, and an extension pipe connecting the suction port to the connection hose, said vacuum cleaner comprising a cyclone dust collecting apparatus disposed between the connection hose and the extension pipe, said apparatus comprising:

a connection pipe having a substantially rectangular cross-section along at least a portion thereof, one side of said rectangular cross-section being concave to provide a contoured surface, said connection pipe in communication with the connection hose and the extension pipe to channel an airstream therethrough;

a cyclone body attached to a downstream end of said connection pipe and containing a filtering mechanism;

a dust collecting receptacle having a substantially cylindrical shape attached to said cyclone body and arranged alongside and in contact with at least a portion of said connection pipe, the dust collecting receptacle configured to collect solid particles trapped by said filtering mechanism and for causing the airstream to travel in a cyclone current therein;

a handle provided on said cyclone body to facilitate use and handling of said vacuum cleaner; and wherein said contoured surface of said connection pipe is configured to matingly contact the substantially cylindrical shape of said receptacle.

* * * * *